US011925849B1

(12) United States Patent
Gonzalez

(10) Patent No.: US 11,925,849 B1
(45) Date of Patent: Mar. 12, 2024

(54) GOLF SWING TRAINING DEVICE

(71) Applicant: David Gonzalez, Tulsa, OK (US)

(72) Inventor: David Gonzalez, Tulsa, OK (US)

( * ) Notice: Subject to any disclaimer, the term of this patent is extended or adjusted under 35 U.S.C. 154(b) by 0 days.

(21) Appl. No.: 17/671,953

(22) Filed: Feb. 15, 2022

Related U.S. Application Data

(60) Provisional application No. 63/149,489, filed on Feb. 15, 2021.

(51) Int. Cl.
*A63B 69/36* (2006.01)
*A63B 71/02* (2006.01)

(52) U.S. Cl.
CPC ..... *A63B 69/36213* (2020.08); *A63B 71/023* (2013.01); *A63B 2071/024* (2013.01); *A63B 2225/093* (2013.01)

(58) Field of Classification Search
CPC ..... A63B 69/36213; A63B 71/023; A63B 2071/024; A63B 2225/093
USPC ..... 473/219, 226, 229, 257, 258, 259, 260, 473/261, 266
See application file for complete search history.

(56) References Cited

U.S. PATENT DOCUMENTS 1,399,761 A * 12/1921 Garland ..... A63B 69/36211 473/258
1,567,530 A * 12/1925 MacNaughton ..... A63B 69/36211 473/259
3,711,103 A * 1/1973 Seltzer ..... A63B 69/36211 473/259
3,794,329 A * 2/1974 Wilson ..... A63B 69/36211 473/229
5,072,942 A * 12/1991 Hurley ..... A63B 69/36211 473/259
5,595,545 A * 1/1997 O'Brien ..... A63B 69/36211 473/259
7,056,224 B1 * 6/2006 Keyes ..... A63B 69/3621 473/229
7,074,133 B1 * 7/2006 Jones ..... A63B 69/3621 473/226
7,806,780 B1 * 10/2010 Plunkett ..... A63B 69/36213 473/229
2005/0075186 A1 * 4/2005 Liao ..... A63B 69/3621 473/259

OTHER PUBLICATIONS

Explanar—Your shortcut to a perfect swing; https://www.explanar.com/.

* cited by examiner

*Primary Examiner* — Nini F Legesse
(74) *Attorney, Agent, or Firm* — Head, Johnson, Kachigian & Wilkinson, PC

(57) ABSTRACT

A golf swing training device comprising a track with a C-shaped cross-section, a roller bearing assembly located within the C-shaped cross-section of the track such that the roller bearing assembly is capable of moving freely along the length of the track but is incapable of disengaging from the track, and a clamp pivotally mounted to the roller bearing assembly, where the clamp is capable of receiving a club shaft. The track may be mounted on height-adjustable legs, allowing the angle of the track to be adjusted. The device may allow a user to practice the user's golf swing without the ability to alter the swing from the path of the track, allowing the user to develop muscle memory to produce a consistent swing.

11 Claims, 6 Drawing Sheets

GOLF SWING TRAINING DEVICE

CROSS REFERENCE

This application is based on and claims priority to U.S. Provisional Application No. 63/149,489 filed Feb. 15, 2021.

BACKGROUND OF THE INVENTION

Field of the Invention

This invention relates generally to a golf swing training device.

Description of the Related Art

In golf, fractions of changes in a swing not only change the result of how and where the ball travels, but also prevents a golfer from developing a perfect, true, and accurate swing every single time they go through the motion. This is often the problem with terrible and even average golfers: they are constantly, without intention, changing the swing of their club.

These changes in a golfer's swing can be prevented by developing muscle memory. Muscle memory is often not about how much and how hard you practice, but how you practice what you are doing. Most physical habits are executed using muscle memory; they are simply habits that we have gotten ourselves used to doing.

It is difficult to develop muscle memory in golf. This is what makes golf so difficult. Most golfers do not swing the club the exact same way every time they swing. That is the core of the problem.

Based on the foregoing, it is desirable to provide a golf swing training device that allows a golfer to habitually, through repetition, develop muscle memory to produce a true and perfect swing.

It is further desirable for the golf swing training device to prevent the user from altering their swing in any way.

SUMMARY OF THE INVENTION

In general, in a first aspect, the invention relates to a golf swing training device comprising: a track with a C-shaped cross-section; a roller bearing assembly located within the C-shaped cross-section of the track such that the roller bearing assembly is capable of moving freely along the length of the track but is incapable of disengaging from the track; and a clamp pivotally mounted to the roller bearing assembly, where the clamp is capable of receiving a club shaft. The track may be circular. The roller bearing assembly may comprise a plurality of roller bearings all of which may be aligned in parallel alignment. Alternatively, at least one roller bearing may be perpendicularly aligned with the other roller bearings. Additionally, the roller bearings may be positioned within the track, outside of the track, or both.

The device may further comprise: a track end plate pivotally attached to the front of the track, where the track rests on a surface via the plate; two back legs, one attached to each of the two sides of the track, where the back legs are height-adjustable; and two sleeve end plates, one pivotally attached to each of the back legs, where the track rests on the surface via the back legs and plates. The device may further comprise a plurality of ground anchors securing the track end plate and the sleeve end plates to the surface.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to a golf swing training device. The device allows a user to attach the user's own golf club to a circular track, allowing the user to swing the golf club in an identical arc repeatedly, thus developing muscle memory. This muscle memory may allow the user to reproduce the identical, perfect swing repeatedly while playing golf.

The device may comprise a track 10, which may be circular, as shown, or may alternately have any curved shape, such as that of an oval or an arc. The track 10 may be formed of any desired material. For example, the track may be made of galvanized steel. The track 10 may be formed of two parts, which may be jointed together via a pair of fasteners 14. The fasteners 14 may be any desired fastener. For example, the fasteners 14 may be ½ inch bolt fasteners with nuts, as shown.

Figure 6:
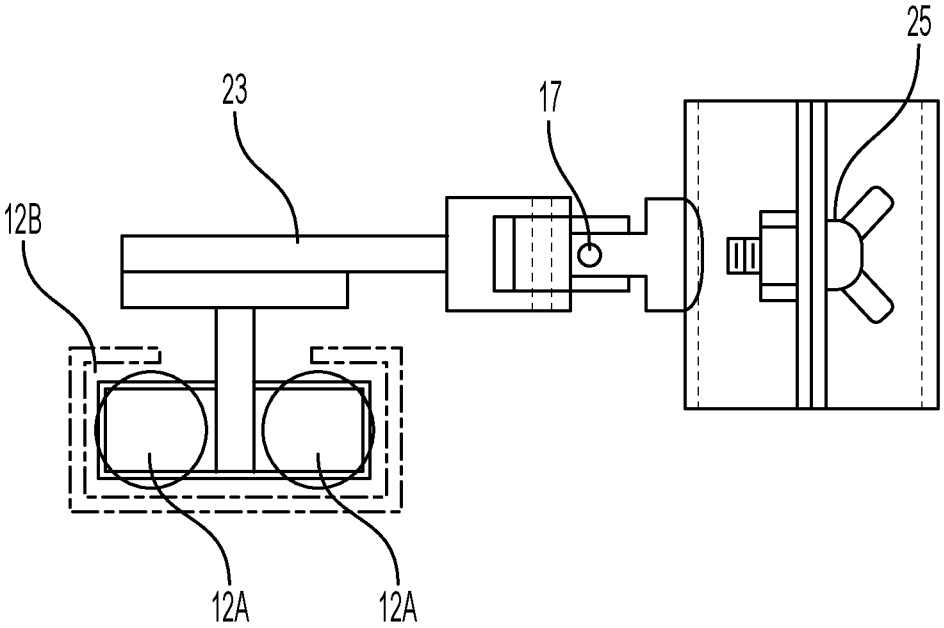
FIG. 6 is a close-up, cutaway side view of a portion of the first embodiment of the device.

The track 10 may have an exterior 10A that is flat and an interior 10B that is grooved, such that the track 10 may accommodate roller bearings 12A in a roller bearing housing 12B. The track may have a generally C-shaped cross section, as shown in FIG. 6, allowing the roller bearings 12A and roller bearing housing 12B to be retained within the track 10 such that the roller bearing housing 12B may travel freely along the length of the track 10 without becoming disengaged from the track 10.

A bearing shaft connector 23 may be attached on one end to the roller bearing housing 12B and attached on an opposing end to a club shaft clamp 16 via a universal joint 17. The universal joint 17 may allow the club shaft clamp 16 to pivot relative to the bearing shaft connector 23. The club shaft clamp 16 may have a clamshell design capable of being opened and closed, and may be secured closed via a clamp adjustment device 25.

In the first embodiment of the present invention, as shown in FIG. 1 through 6, the roller bearings 12A may comprise two rows of four bearings such that the first row of four bearings engages one inner wall of the groove of the interior 10B of the track 10 while the second row of four bearings engages an opposite inner wall of the groove of the interior 10B of the track 10.

Figure 7:
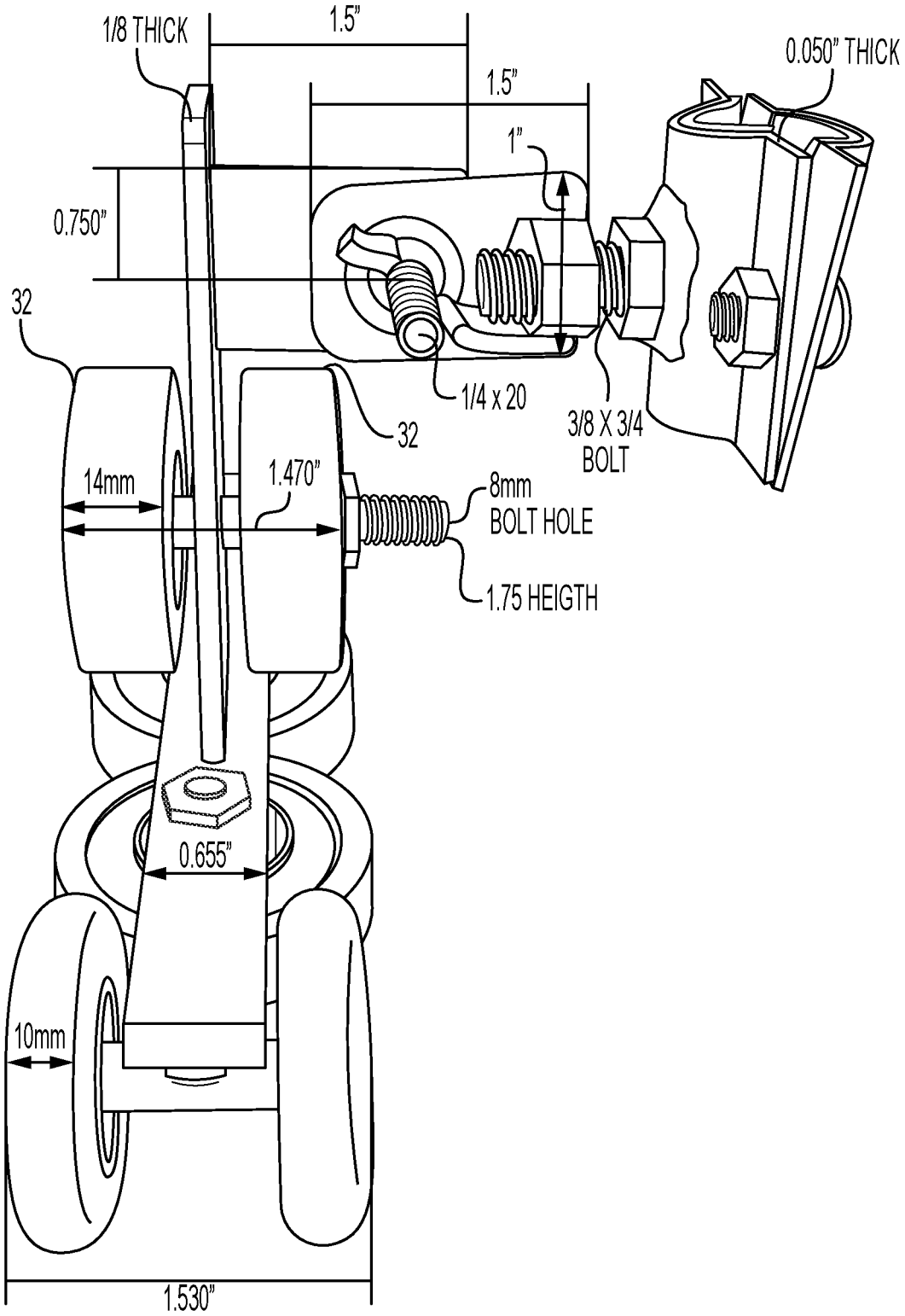
FIG. 7 is a close-up, cutaway front view of a portion of a second embodiment of the device.
Figure 8:
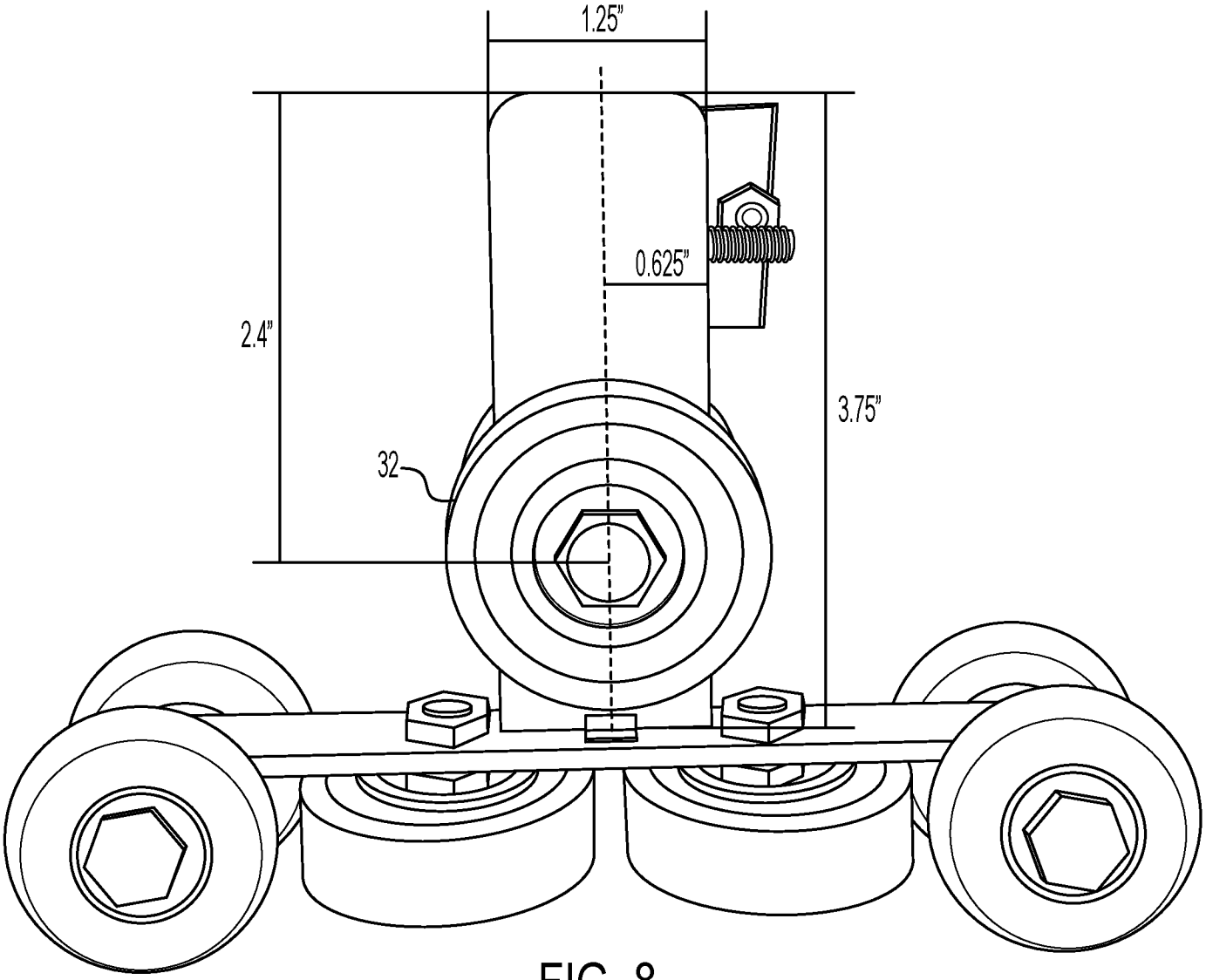
FIG. 8 is a close-up, cutaway side view of a portion of the second embodiment of the device.

In the second embodiment of the present invention, as shown in FIGS. 7 through 8, the roller bearings 12A may be a first set of roller bearings aligned perpendicularly to a second set of roller bearings such that the first set of roller bearings engage the inner side of the interior 10B wall of the track 10 while the second set of roller bearings engage a different, perpendicular interior wall of the track 10. Additional roller bearings 32 may be mounted on the bearing shaft connector 23 such that the additional roller bearings engage the outer side of the interior 10B wall of the track 10.

The track 10 may be mounted at an angle relative to the ground or other surface at the front of the track 10 and further along the track 10. Two hinge swivel plates 22 may be secured at the front of the track 10 and may be spaced out from each other, one on either side of center. Each of the hinge swivel plates 22 may be secured to a hinge swivel plate connector 22A via an attachment device 15. Each attachment device 15 may be any desired attachment device. For example, the attachment device 15 may be a ¾ inch bolt fastener with nut, as shown. The hinge swivel plate connectors 22A may be mounted upon a track end plate stop 20A, which may be secured to the ground or other surface via ground anchors 21.

The back legs 18 may attach to the track 10 on opposing sides thereof at approximately the widest point of the track 10, each via an attachment device 15. The back legs 18 may each be a telescopic height adjustment sleeve, as shown, the two halves of which may be secured at a desired height via an adjustment key pin 19. The back legs 18 may each be secured to a track end plate stop 20A via an attachment device 15. The track end plate stop 20A may be secured to the ground or other surface via a ground anchor 21.

Figure 1:
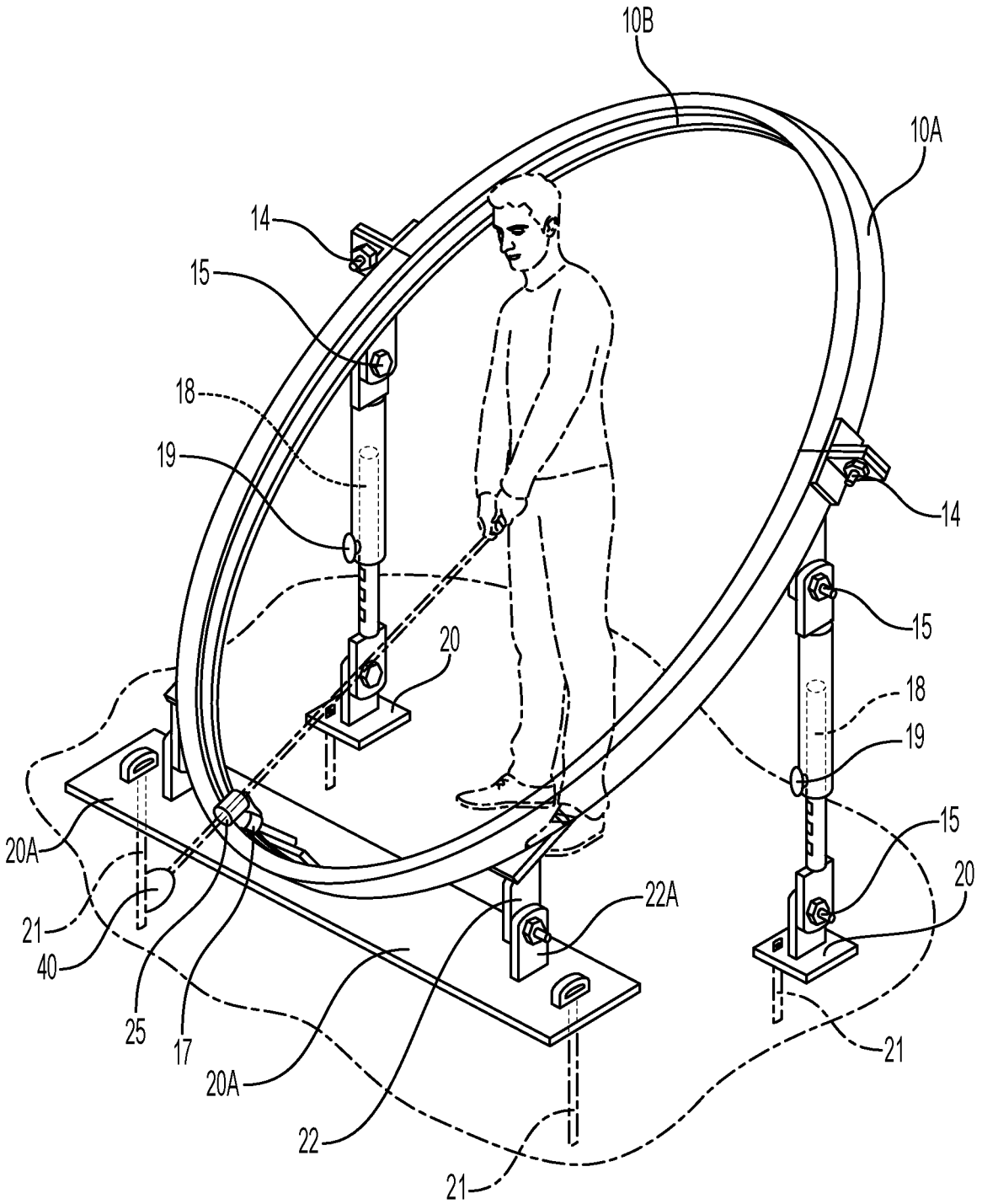
FIG. 1 is a perspective view of a first embodiment of the golf swing training device in use.
Figure 2:
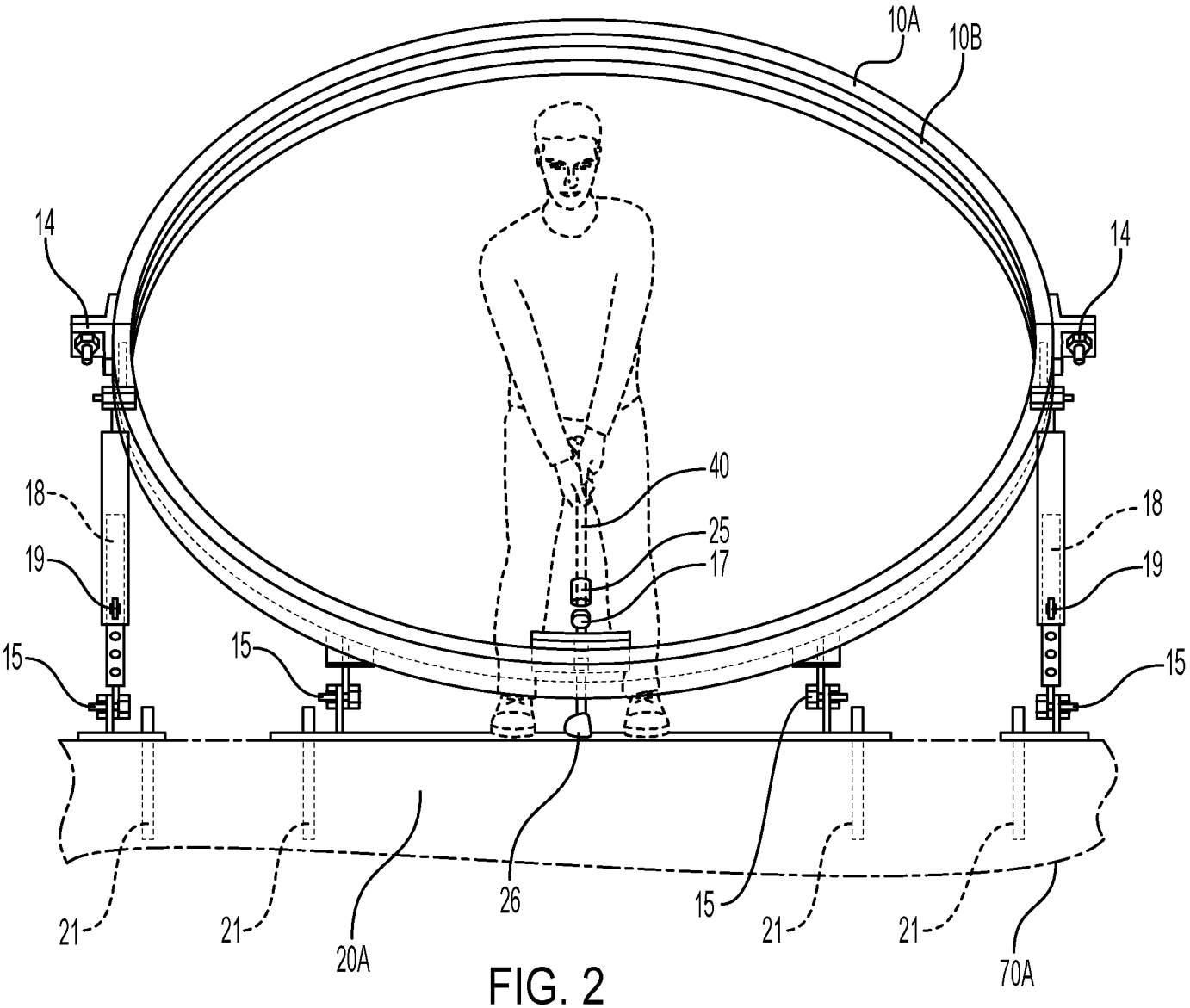
FIG. 2 is a front view of the first embodiment of the golf swing training device in use.
Figure 3:
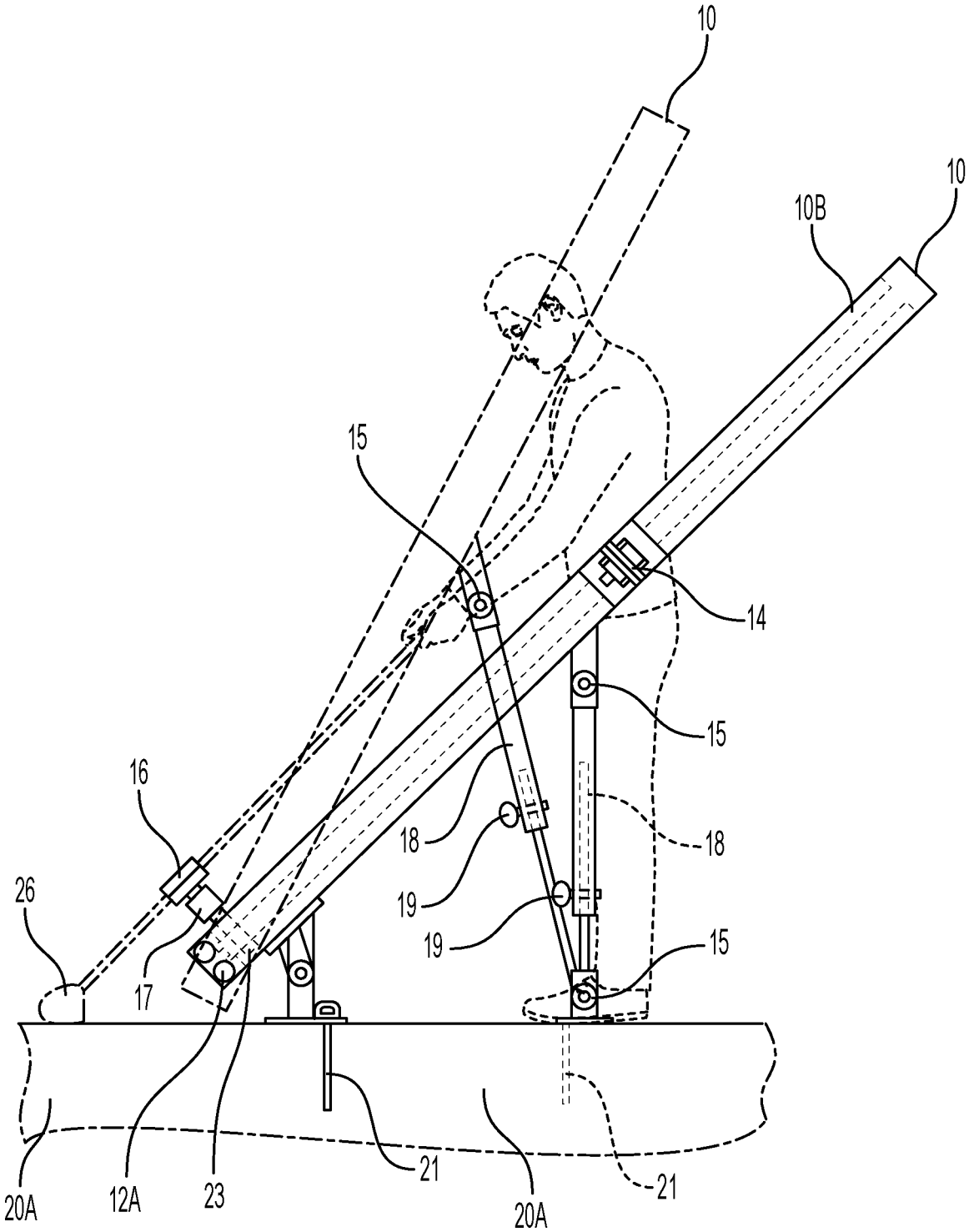
FIG. 3 is a side view of the first embodiment of the golf swing training device in use, showing alternate angles for the device.
Figure 4:
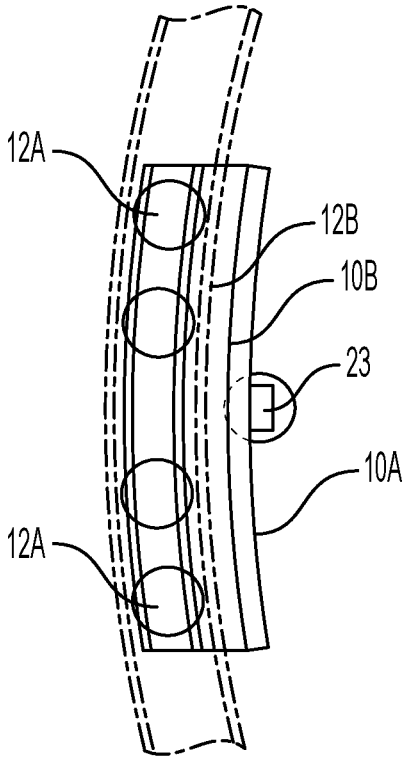
FIG. 4 is a close-up, cutaway front view of a portion of the first embodiment of the device.
Figure 5:
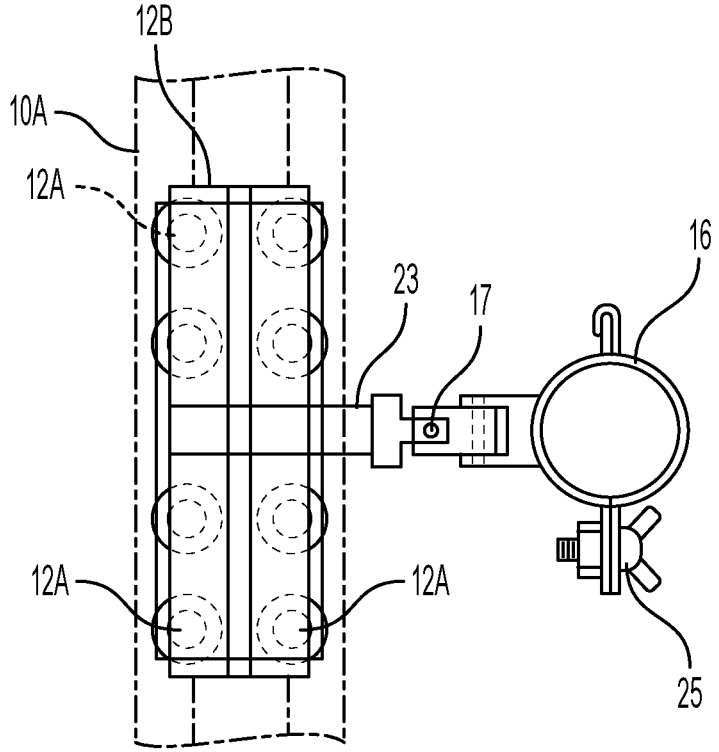
FIG. 5 is a close-up, cutaway top view of a portion of the first embodiment of the device.

The angle at which the lower ends of the back legs 18 attach to the track end plate stops 20A and the angle at which the hinge swivel plate attaches to the hinge swivel plate connector may be adjustable, depending on the length at which the back legs 18 are set, allowing for the angle of the track 10 to be adjusted, as shown in FIG. 3.

During use, the user may adjust the height of the back legs 18 so that the track 10 is at a desired angle. The user may open the clamp 25 and place a club shaft 40 therein, with the head 26 of the club pointing away from the device, and secure the clamp 25 to hold the club shaft 40 in place. The user may stand approximately between the back legs 18 and grip the club shaft 40 as the user would normally grip the club for use, and may execute a swing, allowing the roller bearing housing 12B to travel along the track 10, thus ensuring the club follows an exact path throughout the swing. The user may repeat the identical swing until muscle memory is achieved, allowing the user to replicate the perfect swing consistently without the device while playing golf.

Whereas, the devices and methods have been described in relation to the drawings and claims, it should be understood that other and further modifications, apart from those shown or suggested herein, may be made within the spirit and scope of this invention.

What is claimed is:

1. A golf swing training device for use with a golf club comprising a club shaft, a club head, and a club grip, the golf swing training device comprising:

a track with a C-shaped cross-section with an open channel such that the open channel is located on an inner surface of the track;

a roller bearing assembly located within the C-shaped cross-section of the track such that the roller bearing assembly is capable of moving freely along the length of the track but is incapable of disengaging from the track; and a clamp pivotally mounted to the roller bearing assembly, where the clamp is capable of receiving the club shaft at a location closer to the club head than the club grip;

wherein said roller bearing assembly further comprises a plurality of roller bearings; and wherein at least one roller bearing of said plurality of roller bearings is aligned perpendicularly to at least one other roller bearing of said plurality of roller bearings.

2. The golf swing training device of claim 1 where the track is circular.

3. The golf swing training device of claim 1 where the track has a front and two sides, the device further comprising:

a track end plate pivotally attached to the front of the track, where the track rests on a surface via the plate;

two back legs, one attached to each of the two sides of the track, where the back legs are height-adjustable; and two sleeve end plates, one pivotally attached to each of the back legs, where the track rests on the surface via the back legs and plates.

4. The golf swing training device of claim 3 further comprising a plurality of ground anchors securing the track end plate and the sleeve end plates to the surface.

5. The golf swing training device of claim 1 wherein each roller bearing of said plurality of roller bearings is aligned parallel to each other roller bearing of said plurality of roller bearings.

6. The golf swing training device of claim 1 wherein at least one roller bearing of said plurality of roller bearings is positioned within said track.

7. A golf swing training device for use with a golf club comprising a club shaft, a club head, and a club grip, the golf swing training device comprising:

a track with a C-shaped cross-section with an open channel such that the open channel is located on an inner surface of the track;

a roller bearing assembly located within the C-shaped cross-section of the track such that the roller bearing assembly is capable of moving freely along the length of the track but is incapable of disengaging from the track; and a clamp pivotally mounted to the roller bearing assembly, where the clamp is capable of receiving the club shaft at a location closer to the club head than the club grip;

wherein said roller bearing assembly further comprises a plurality of roller bearings;

wherein at least one roller bearing of said plurality of roller bearings is positioned within said track; and wherein at least one roller bearing of said plurality of roller bearings is positioned outside of said track.

8. The golf swing training device of claim 7 where the track is circular.

9. The golf swing training device of claim 7 where the track has a front and two sides, the device further comprising:

a track end plate pivotally attached to the front of the track, where the track rests on a surface via the plate;

two back legs, one attached to each of the two sides of the track, where the back legs are height-adjustable; and two sleeve end plates, one pivotally attached to each of the back legs, where the track rests on the surface via the back legs and plates.

10. The golf swing training device of claim 9 further comprising a plurality of ground anchors securing the track end plate and the sleeve end plates to the surface.

11. The golf swing training device of claim 7 wherein each roller bearing of said plurality of roller bearings is aligned parallel to each other roller bearing of said plurality of roller bearings.

* * * * *